US008322016B2

(12) United States Patent
Kirkham et al.

(10) Patent No.: US 8,322,016 B2
(45) Date of Patent: Dec. 4, 2012

(54) METHOD FOR MAKING LIGHTWEIGHT, CAST TITANIUM HELMETS AND BODY ARMOR

(76) Inventors: David V. Kirkham, Provo, UT (US); Jeffrey B. Kirkham, Portland, OR (US)

( * ) Notice: Subject to any disclaimer, the term of this patent is extended or adjusted under 35 U.S.C. 154(b) by 982 days.

(21) Appl. No.: 12/361,464

(22) Filed: Jan. 28, 2009

(65) Prior Publication Data

US 2012/0180634 A1 Jul. 19, 2012

Related U.S. Application Data

(60) Provisional application No. 61/062,905, filed on Jan. 29, 2008.

(51) Int. Cl.
*B22D 25/06* (2006.01)
*B21D 53/00* (2006.01)
*F41H 1/04* (2006.01)

(52) U.S. Cl. ..... 29/527.1; 29/527.5; 29/527.6; 29/407.05; 164/519; 2/6.6; 2/2.5; 89/36.05

(58) Field of Classification Search ..... 29/527.5, 29/527.6, DIG. 5, DIG. 45, 407.05, 527.1, 29/527.2; 2/626, 2.5; 164/516–519; 89/36.05, 89/36.02

See application file for complete search history.

(56) References Cited

U.S. PATENT DOCUMENTS

| | | | | |
|---|---|---|---|---|
| 4,021,910 | A * | 5/1977 | Freeman et al. | 29/526.2 |
| 5,706,566 | A * | 1/1998 | Igarashi | 29/527.5 |
| 6,029,269 | A * | 2/2000 | El-Soudani | 2/2.5 |
| 2007/0137827 | A1 * | 6/2007 | Vogt et al. | 164/113 |
| 2007/0209191 | A1 * | 9/2007 | Rice | 29/527.5 |
| 2008/0141429 | A1 * | 6/2008 | Scharpenack et al. | 2/2.5 |

* cited by examiner

*Primary Examiner* — Jermie Cozart
*Assistant Examiner* — Jason L Vaughan
(74) *Attorney, Agent, or Firm* — Workman Nydegger

(57) ABSTRACT

Methods for manufacturing cast titanium helmets include casting a helmet in an oversized mold. The resulting oversized cast helmet is then exposed to a hot isostatic press (HIP) process that applies heat and pressure for a predetermined period of time. The resulting oversized cast helmet is then exposed to an acid bath that chemically mills the helmet to a desired thickness and removes contaminants formed during casting of titanium.

18 Claims, 2 Drawing Sheets

METHOD FOR MAKING LIGHTWEIGHT, CAST TITANIUM HELMETS AND BODY ARMOR

CROSS-REFERENCE TO RELATED APPLICATIONS

This application claims the benefit and priority of U.S. Provisional application 61/062,905, filed Jan. 29, 2008, entitled "METHOD FOR MAKING LIGHTWEIGHT, CAST TITANIUM HELMETS AND BODY ARMOR", and which is incorporated by reference in its entirety.

BACKGROUND

Helmets and defensive body armor are typical equipment utilized by militaries throughout the world. The effectiveness of such equipment is related to both its strength and weight. Preferably, the armor will be both strong and light. The lighter the armor is, the easier it is to carry. The stronger the armor is, the more potential it has to successfully defend against an attack. However, in order to increase the strength of the armor, it is typically necessary to increase at least the thickness and/or density of the armor. Unfortunately, this will also increase the net weight of the armor. And, if the weight is increased too much, the armor can actually become more of an encumbrance than assistance during battle.

In view of the foregoing, there is an ongoing desire for the military to utilize materials that are both lightweight and strong. Titanium is one material that has been found to provide desirable strength to weight ratios, as well as beneficial anticorrosion properties. Accordingly, militaries have started incorporating increased amounts of titanium in their equipment. However, as described below, titanium is not practical in traditional forms of manufacture, such as casting.

To provide the specific strength and weight ratios that are desired, titanium is typically alloyed with various other elements, such as iron, aluminum, vanadium, molybdenum, as well as various other elements. It is anticipated that ongoing research will continue to develop new and interesting combinations of elements to incorporate into titanium alloys, as well as processes for manufacturing the alloys.

As the demand for titanium increases, the availability of refined titanium alloys remains somewhat restricted and the manufacturers of products incorporating titanium often experience long wait times for the specific alloys that are desired. Naturally, this increases the relative cost of utilizing titanium alloys in military equipment.

Another problem experienced by military product suppliers utilizing titanium, is that titanium is very difficult to cast, particularly into thin-walled products like helmets and body armor because of titanium's high melting point, around 3000° F., and low fluidity (the ability of the metal to flow into a mold when molten). In addition, titanium is highly reactive and has a high chemical affinity when molten. This causes the titanium to react with the surface of the mold, contaminating the casting and thereby causing inferior mechanical properties of the resultant titanium product.

For example, the reaction of molten titanium with a mold material during casting will also create oxide contaminates, such as 'alpha case', on the surface of the titanium. Alpha case is extremely hard and brittle and renders the casting subject to brittle failure and less suitable for ballistic protection.

The contamination that occurs during casting of titanium also increases the impracticality of superheating the titanium above the molten state in order to enhance the fluidity of the titanium, to help fill thin-wall casting molds. In particular, superheating the titanium above molten temperatures creates risks of even more severe contamination during the casting.

Titanium's high melting point also makes it difficult to ensure that an entire mold will be filled before the titanium begins to freeze or solidify within the mold. This problem is even more pronounced when casting titanium into thin-walled molds, since it can be difficult to maintain the titanium at the relatively high melting point of around 3000° F., during the entire casting process. As a result, the titanium will often freeze within the mold before the entire mold is filled, thereby resulting in product imperfections and holes that are clearly unacceptable for military applications, such as for helmets, body armor and many other products.

In view of the foregoing, casting titanium is often overlooked as a viable method for producing thin, bullet resistant helmets and body armor.

In order to form helmets and other thin walled armor products out of titanium, some manufacturers have begun using manufacturing processes, other than casting, such as superplastic and stamping processes. However, these processes require the titanium to be prefabricated into specific configurations, such as thin uniform sheets, that are amenable to the superplastic formation. Unfortunately, this eliminates the practical use of much of the available titanium, such as scrap titanium and titanium sponge. The prefabrication requirements also increase the relative costs and wait times for the desired titanium alloys.

BRIEF SUMMARY OF THE INVENTION

The present invention provides methods for making titanium helmets and body armor with casting processes.

In one embodiment, according to the present invention, a titanium helmet is formed by casting the helmet in an oversized mold. The resulting oversized cast helmet is then exposed to a hot isostatic press (HIP) process that applies heat and pressure for a predetermined period of time. This HIP'ing helps to cure imperfections such as voids and micro-shrinkage that are present in the oversized cast helmet as well as improving the metallurgical properties of the titanium. The oversized cast helmet is also exposed to an acid bath that chemically mills the helmet to a desired thickness and removes external contaminants formed during casting.

Helmets formed through the inventive processes of the present invention have shown unexpected and surprising strength for titanium castings.

In other embodiments, body armor plates (such as chest, arm or leg plates) are formed by casting the armor plates in an oversized mold. The oversized cast plates are then exposed to a HIP'ing process for a predetermined period of time. The resulting oversized cast plates are then exposed to an acid bath to chemically mill the armor plates to the desired size and to remove the alpha case and other external contaminants formed during the casting.

This Summary is not intended to identify key features or essential features of the claimed subject matter, nor is it intended to be used as an aid in determining the scope of the claimed subject matter.

BRIEF DESCRIPTION OF THE DRAWINGS

In order to describe the manner in which the above-recited and other advantages and features can be obtained, a more particular description of various embodiments will be rendered by reference to the appended drawings. Understanding that these drawings depict only sample embodiments and are not therefore to be considered to be limiting of the scope of the invention, the embodiments will be described and explained with additional specificity and detail through the use of the accompanying drawings in which.

BRIEF DESCRIPTION OF THE DRAWINGS

Figure 1:
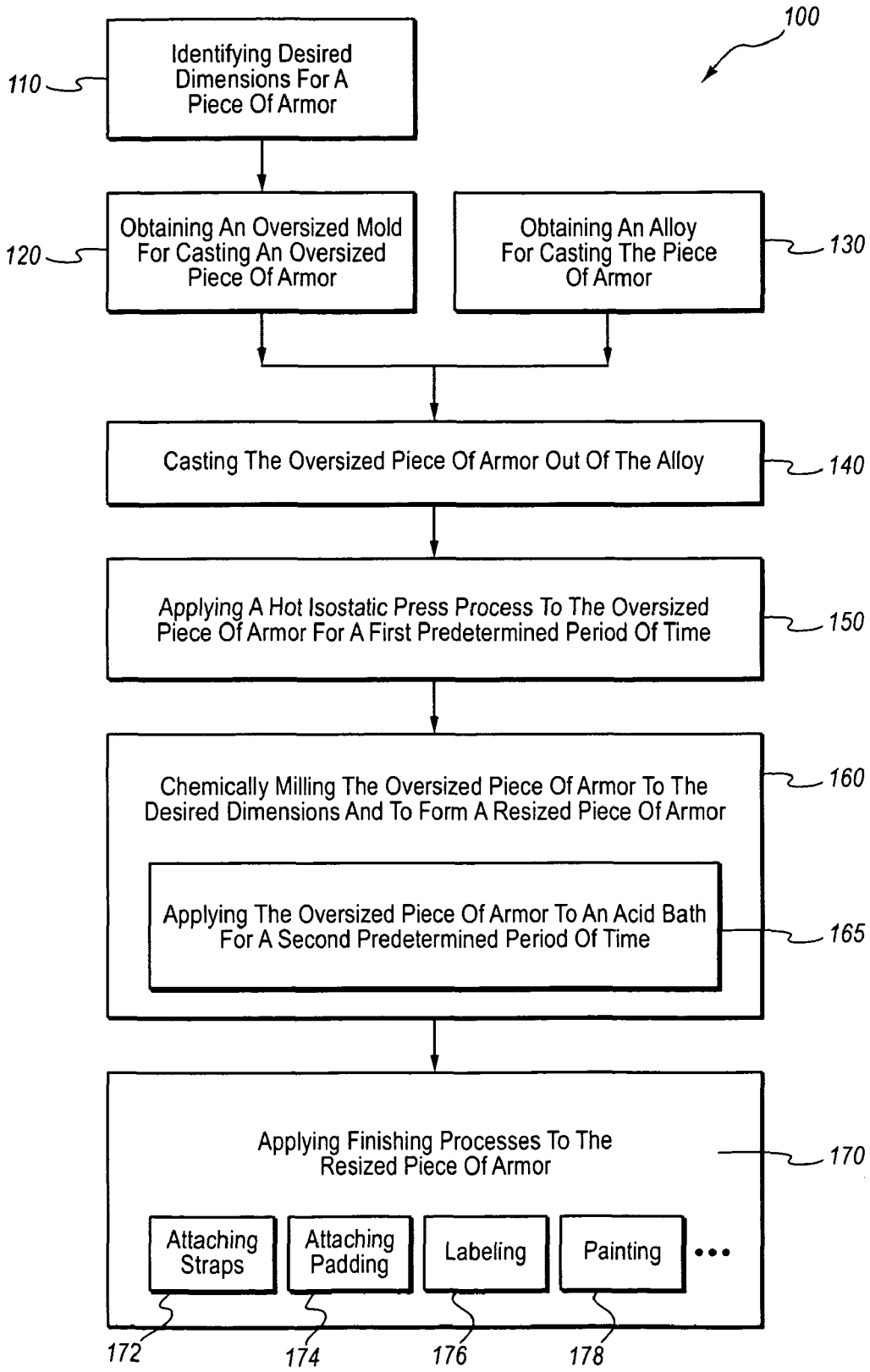
FIG. 1 illustrates a flowchart with acts and steps for forming helmets and other pieces of armor according to some embodiments of the invention.

The present invention provides methods for making cast titanium and cast titanium alloy helmets and body armor.

As mentioned above, titanium has been found to possess desirable qualities for protective armor; namely, it is strong and relatively light. However, it has heretofore been impractical to cast helmets and other thin-wall armor castings with titanium alloys because the titanium reacts adversely with the mold during the casting process and creates surface contaminants that leave the castings susceptible to brittle failure. The high melting point of the titanium also makes it likely that the titanium will freeze during the casting process, prior to filling an entire mold, particularly in thin-wall applications. This can result in porous and irregular surface formations. As a result, it has been considered impractical to cast titanium helmets and other thin-walled armor.

Accordingly, alternative manufacturing processes are currently used to form titanium helmets, such as superplastic forming processes. However, these alternative processes are relatively expensive and time consuming, particularly when considering the wait time and expense associated with acquiring necessary prefabricated titanium alloys.

The present invention addresses some of the foregoing problems by utilizing oversized molds and casting the desired objects in an oversized dimension (e.g., thicker than the desired dimensions). The oversized objects are then resized through a plurality of refining processes. The term "oversized" should be broadly construed to apply to any size larger than a final desired size of the object (e.g., helmet, body armor, and so forth).

In some embodiments, the term "oversized" corresponds to a mold or product that is up to at least 10% larger (in thickness) than a desired final size of the final product that is being formed. In other embodiments, the term "oversized" corresponds to a size that is at least 20% larger in thickness than the desired final size. In yet other embodiments, the term "oversized" corresponds to a size that is between at least 30%-40% of the desired final size or 40%-50% of the desired final size. Finally, the term "oversized" can also refer to a size that is greater than 50% of the desired final size, and even more than 100% of the desired final size, and even more than 200% of the desired final size (thickness). It will be noted that the term oversized, as used herein, is an oversizing by a significant percentage, with the term significant percentage being defined by any percentage beyond the customary oversizing that is provided for shrinkage allowance in typical casting applications.

As described herein, various titanium alloys are used to form the castings. These titanium alloys can be any suitable alloys, including, but not limited to 6Al 4V titanium alloy. There are currently about 50 grades of titanium alloys, any of which can be utilized according to certain aspects of the present invention to form titanium castings of helmets and body armor. In some embodiments, alloys other than titanium alloys, having properties similar to titanium alloys can also be used interchangeably with the titanium alloys. It is also anticipated that new alloys that have yet to be discovered can also be used.

The term "casting" is mentioned at various times throughout this paper with specific reference to traditional investment type castings. However, it will be appreciated that the term "casting" is more broadly defined by this paper to apply to all types of expendable casting and even non-expendable casting processes. Expendable and non-expendable casting processes are well known to those of skill in the art.

Attention will now be directed to FIG. 1, which illustrates a flowchart of one embodiment of the methods of the invention for forming titanium cast helmets and body armor.

As illustrated, the method begins by identifying the desired dimensions for a piece of armor (act 110). The term armor can include a helmet or any other body armor, such as armor plates like breast plates, shoulder plates, back plates, thigh plates, shin guards, as well as other types of body armor.

The desired dimensions can be obtained from a commercial client who has specified the dimensions. Alternatively, the manufacturer of the product being supplied to the commercial client will create the dimensions. In some embodiments, the desired dimensions for the pieces of armor are calculated according to the specific characteristics needed for the armor. In particular, the specific strength requirements for a product can be considered when calculating the desired dimensions. In one embodiment, a computing system receives input comprising the strength requirements and provides different possible alloy material and thickness specifications. In other embodiments, a computing system receives input comprising both the strength requirements as well as the alloy(s) to be used. The computing system then dynamically calculates the required and desired dimensions.

An oversized mold is also obtained (act 120) according to the embodiments of the invention. The oversized mold can be obtained by manufacturing or purchasing a non-expendable or expendable mold that is created with oversized dimensions, as compared to the desired dimensions of the piece of armor. The size dimensions for the oversized mold can be specified by the computing system in response to receiving input from the user that specifies how much milling or etching of the product will occur after the product (e.g., helmet or armor) is cast. In other embodiments, the computing system will alternatively calculate the amount of milling or etching that will subsequently take place in response to user input specifying a type of chemical solution and/or acid that will be applied to the casting, as well as the duration of time in which the casting will be exposed to the chemical solution and/or acid. Other user input can also be input into the computing system and used to calculate the size dimensions for the oversized mold, such as, but not limited to, a duration of time in which the cast product will be exposed to a hot isostatic press (HIP) process and other processes that can affect the size of the cast product.

In other embodiments, the oversized mold is formed from an investment wax model or another investment casting object that is oversized, as compared to the desired dimensions of the final product to be formed, and as calculated to be appropriately oversized in view of the HIP process and chemical milling processes, as well as any other processes that will be applied to reduce the size of the casting.

The investment casting mold can also be formed by applying one or more special slurries to the mold, including a primary coating of a relatively inert material, such as zircon sand, thorium oxide or graphite, as well one or more secondary coats of a less expensive and less inert materials. The various types of slurries that can be applied to the investment wax mold are well known to those of skill in the art, as are the other processes involved in performing an investment casting.

As mentioned above, the oversized mold is oversized as compared to the ultimate desired dimensions of the piece of armor being formed, by a significant percentage, which is any percentage beyond the customary oversizing that is provided for shrinkage allowance in typical casting applications. In some embodiments, the mold is oversized in thickness (relative to the desired dimensions) by at least 10% and up to about 50% or even more (e.g., 100% or more). However, the mold can also be oversized by less than 10% in thickness (relative to the desired dimensions), such as by as little as 9%, 8%, 7%, 6%, 5%, or even 1%-5%, as long as it is more than is typically allotted for the shrinkage allowance of the article being cast.

The method illustrated in FIG. 1 also indicates the need to obtain an alloy for casting the piece of armor (act 130). This can include obtaining any alloy that will satisfy the desired strength characteristics for the armor. In one embodiment, acceptable alloys are specified by a client or calculated by a computing system in response to receiving input that identifies the desired dimensions.

A manufacturer can also obtain the alloy (such as a titanium alloy) from available scrap metal that is capable of being melted and cast. Scrap titanium alloy, such as aircraft manufacturing trim, shavings and millings left over during plane manufacture, as well as titanium sponge, and other sources of scrap titanium is more readily available and less expensive than prefabricated sheets of titanium alloy. In this regard, it will be appreciated that casting titanium can provide advantages over other titanium forming processes that are unable to use scrap metal or other metal that is not formed into sheets of relatively uniform thickness.

The oversized pieces of armor are then cast (act 140), using the oversized molds and obtained alloy(s). In one embodiment, the alloy that is used is a titanium alloy commonly known as 6Al 4V.

The actual process involved in performing the casting will depend on whether the casting is an expendable casting, such as a traditional investment casting or a non-expendable casting process. In either regard, it will be noted that the casting process of the armor will be more successful, using the oversized dimensions, than it would have been using standard dimensions for a thin-walled mold. In particular, the larger dimension (increased thickness) of the mold enables the titanium alloy to more easily fill the entire mold prior to freezing (dropping below the melting point of about 3000° F. and solidifying). The larger dimension also reduces the total percentage of the product that is contaminated with surface contaminants, such as alpha case that can subject the armor to brittle failure. The larger casting also facilitates the removal of the contaminants without unduly thinning or breaking the armor during chemical or mechanical milling.

It will be noted that the casting of the oversized piece of armor can be conducted on an individual basis, or as a batch, with one or more other pieces of armor being cast at the same time.

Once the casting is complete the piece(s) of armor are exposed to a HIP process (act 150). The HIP process, which is well known to those of skill in the art, effectively heals voids and micro-shrinkage that are present in titanium castings. HIP'ing also increases the density of the casting.

HIP'ing is performed by placing the casting into a sealed chamber that subjects the casting to both heat and pressure for a predetermined period of time. An inert gas is used to generate the pressure so as to not contaminate the casting. The temperature of the chamber is preferably set around 1650° F. with a pressure of about 15,000 psi, applied to the casting from all sides. The predetermined time for exposing the armor to the HIP process will preferably be around 2 hours, although the time, the pressure and temperature can all vary, as appropriate for the various different alloys being used, and as calculated by the computing system, to accommodate different desired mechanical characteristics of the product.

Since titanium becomes very plastic at 1650 degrees F., the armor within the chamber responds to the applied pressure in a positive way, by closing the voids, micro-shrinkage, microporosity, and/or other defects that may have resulted from the casting, through diffusion bonding, plastic deformation and creep. This creates a resulting product that has better metallurgical properties than are available with traditional casting alone.

The armor is also exposed to a chemical milling process that will reduce the size (thickness) of the armor (act 160). In one embodiment, this is performed through the application of an acid bath (act 165). However, it will be appreciated that any chemical solution and application of the chemical can be used, as long as it is adequate to etch or mill away the alloy casting. These solutions include, but are not limited to Hydrofluoric Acid, Oxalic Acid and Nitric solutions, as well as Peroxides and other acids and chemicals.

The longer the armor is exposed to the chemical milling solution(s), the more chemical milling will occur. In some instances, pluralities of different chemical solutions or baths are applied at different times and in different sequences. The chemical baths that are applied also provide the beneficial result of removing the surface contaminants on the armor, such as alpha case oxides.

According to one embodiment, the chemical milling process is used to reduce the thickness of the armor by at least 1 mm. In other embodiments, the chemical milling process is used to reduce the thickness of the armor by less than 1 mm or more than 1 mm, such as by as much as 1 mm-2 mm, or by even more than 2 mm.

In one embodiment, the amount of time that the armor is exposed to the chemical/acid bath(s) is predetermined and calculated by a computing system having input specifying the type(s) of chemicals being applied, the oversized thickness of the armor and the desired ultimate size (thickness) of the armor.

In other embodiments, the armor is exposed to the chemical baths for an undetermined period of time, which can vary according to the preferences of the manufacturer, who periodically checks the thickness of the armor, as it is being chemically milled. Automated systems that check the thickness of the armor and for ending the exposure to the chemical bath can also be utilized.

Once the armor is reduced in size to the desired size, any number of finishing processes are applied (act 170), including for example, attaching straps (172), attaching padding (174), labeling (176), painting (178), as well as others, such as, but not limited to cleaning and packaging.

In one alternative embodiment, the finishing process includes hardening at least the surface of the helmet or armor through the application of a chemical solution and/or a mechanical process. By way of example, and not limitation, a nobleizing process can be used to harden the surface of the helmet or armor. Nobleizing the armor, or otherwise hardening the armor can help make the armor more capable of diffusing impacts, such as, but not limited to bullet impacts. Quench hardening processes can also be used to harden the armor. In yet other embodiments, shot peening or another cold working processes are used to further harden the manufactured product, in combination with or excluding the foregoing hardening processes. In fact, any combination of the foregoing and other hardening processes can be used.

With specific regard to the flowchart 100 shown in FIG. 1, it will be appreciated that it is not always essential for every illustrated act to be performed in the sequence shown. By way of example and not limitation, the act of applying the finishing processes can be avoided. Certain chemical milling processes can also occur prior to the application of the HIP processes and, in some embodiments after as well. Suitable alternatives can also be used. For example, in one embodiment, mechanical milling and polishing processes are used instead of, or in combination with, the chemical milling processes. Accordingly, it will be appreciated that various alternative methods and processes for forming cast titanium alloy armor are also covered by the present invention, in addition to those explicitly described.

In one alternative embodiment, for example, the oversized helmets or other oversized armor castings are actually formed through one or more processes that are not thought of as traditional casting processes. One alternative process is powder metallurgy/sintering. In this embodiment, powder metallurgy is used to form the initial blank (the oversized helmet or armor) that has oversized dimensions. The oversized helmet or armor is then exposed to one or more of the chemical and/or mechanical milling processes that have been described above to resize the armor.

In view of the foregoing, it should be evident that it is now possible to manufacture titanium helmets and other thin-walled armor with casting processes without undesirably affecting their performance. This is surprising and unexpected for at least the reasons articulated above, namely casting of titanium is known to create brittleness due to the surface contaminants formed during casting, the difficulty in completely filling a thin-wall mold with titanium at melting point, without creating voids and irregularities, and so forth.

Figure 2A:
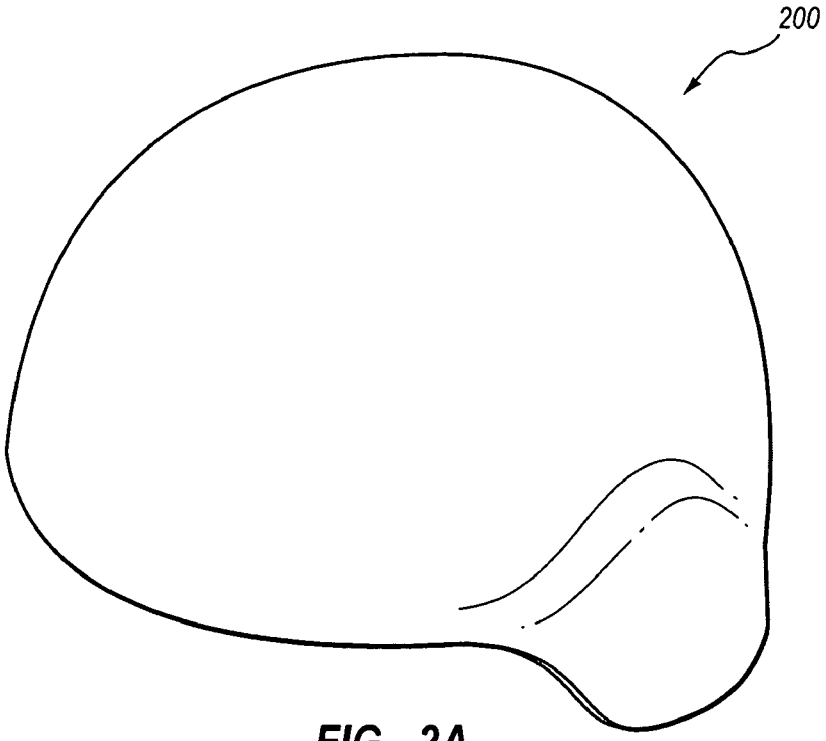
FIGS. 2A and 2B illustrate a side perspective view and a top view, respectively, of a titanium helmet that has been formed according to one method of the present invention, corresponding to the flowchart of FIG. 1.
Figure 2B:
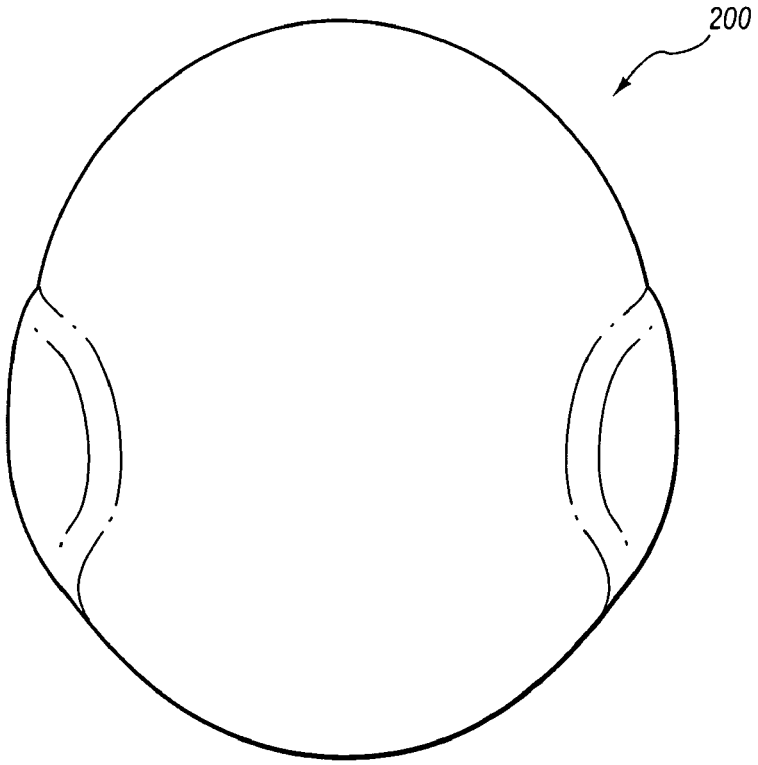

FIGS. 2A and 2B illustrate one example of a lightweight cast titanium helmet 200 that can be formed from the processes described above.

A plurality of helmets similar to the helmet 200 illustrated in FIG. 2A were cast from alloy 6Al 4V titanium and was exposed to the HIP process for about 2 hours at about 1650° F. and about 15,000 psi. The helmets were also subsequently milled in an acid bath to thicknesses ranging from about 1.5 mm to about 2 mm from initial oversized castings ranging from about 2.5 mm to about 4 mm.

One of the manufactured helmets, having a final thickness of about 1.5 mm, was also exposed to a battery of tests that confirmed the surprising results of strength existing in a titanium cast helmet formed according to the present invention.

During an initial test, samples of the casting batch were tested to have about 146,000 psi ultimate tensile strength, about 133,000 psi yield strength, and 9% elongation. These measurements approximate the mechanical specifications of wrought 6Al 4V titanium (138,000 psi ultimate tensile strength, 128,000 psi yield strength and 14% elongation), verifying the avoidance of many of the problems that are typically associated with casting thin-walled titanium products.

Ballistics testing was also performed. The helmet was shot with a 9 mm Ruger pistol and a High Point 9 mm Carbine rifle with American Eagle Federal Cartridge Company 9 mm Pistol Cartridges (115 grain, full metal jacket). The muzzle velocity of the munitions was obtained with a ProChrono-Digital Chronograph by firing 10 shots from the High Point Carbine and 10 shots from the Ruger pistol through the chronograph and measuring the bullet velocity.

The average muzzle velocity from the High Point Carbine (with ten sample shots) was calculated to be about 1305.5 ft/sec. The average muzzle velocity from the Ruger pistol (with ten sample shots) was calculated to be about 1173.5 ft/sec.

The helmet was lodged in the ground and shot in the back portion of the helmet from a distance of about 66 feet with the High Point Carbine. The round bounced off. Next, the helmet was shot at the side at 42 feet with the Ruger pistol. Again, the round bounced off. Next, the front of the helmet was shot at a distance of about 66 feet with the High Point Carbine. The round bounced off. Finally, the front of the helmet was shot again from a distance of about 88 feet with the High Point Carbine. The round impacted 2.25 inches from the previous hit and bounced off. The ability of the helmet to withstand this second frontal impact was particularly surprising, since the previous round had already struck the helmet in such close proximity to the second impact. (It is surprising that the first frontal impact did not weaken the helmet to the point of failing on the second frontal impact). While the impact of the bullets was noticeable on the helmet surface, the deformation caused to the helmet was very negligible (indentations of about an eighth of an inch in depth to about a quarter of an inch in depth were formed at each impact site, with diameters of about a quarter of an inch at each impact site).

At least the foregoing testing confirms that the methods of the present invention can be used to produce titanium helmets and other body armor through casting processes, rather than relying on existing processes that require prefabricated titanium sheet metal.

Embodiments within the scope of the present invention apply to the described methods and processes, as well as the products that are manufactured through the described methods and processes, such as the helmets, body armor and other thin wall titanium alloy armor.

Embodiments of the present invention also include to computing systems that have been configured with processors and other specific hardware, such as circuits used to compute the dimensions (the desired dimensions and oversized dimensions), times (for the acid bath and HIP processes), as well as for identifying measured progress of the milling processes, and for monitoring and setting desired temperatures during casting and the HIP processes, and that have been configured to implement computer-executable instructions stored on storage media for implementing acts of the invention, such as, for example, identifying the desired and oversized dimensions and so forth. Embodiments of the present invention also include the computer-readable media and computer aided design (CAD) systems storing the computer-executable instructions referenced above.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A method for manufacturing a thin-wall titanium alloy helmet, the method comprising:

identifying desired dimensions for the helmet, including a desired thickness;

obtaining an oversized mold for casting an oversized helmet having a thickness that is greater in size than the desired thickness;

obtaining a titanium alloy for casting the oversized helmet in the oversized mold;

casting the oversized helmet with the titanium alloy in the oversized mold;

applying a hot isostatic press process to the oversized helmet for a predetermined period of time; and chemically milling the oversized helmet to at least reduce the thickness of the oversized helmet to the desired thickness and to create a resized helmet.

2. The method recited in claim 1, wherein the desired dimension is between about 1 mm and 6 mm.

3. The method recited in claim 2, wherein the oversized mold and helmet are at least 10% thicker than the desired thickness.

4. The method recited in claim 3, wherein the oversized mold and helmet are at least 20% thicker than the desired thickness.

5. The method recited in claim 4, wherein the oversized mold and helmet are at least 30% thicker than the desired thickness.

6. The method recited in claim 5, wherein the oversized mold and helmet are at least 40% thicker than the desired thickness.

7. The method recited in claim 6, wherein the oversized mold and helmet are at least 50% thicker than the desired thickness.

8. The method recited in claim 1, wherein the hot isostatic press process is applied prior to the chemical milling.

9. The method recited in claim 1, wherein the chemical milling includes applying the oversized helmet to an acid bath.

10. The method recited in claim 9, wherein the acid bath includes Hydrofluoric Acid.

11. The method recited in claim 1, wherein the titanium alloy is a scrap metal or a metal sponge in a form other than a fabricated sheet metal having a substantially uniform thickness.

12. The method recited in claim 1, wherein the titanium alloy of the resized helmet has properties that approximate wrought 6Al 4V titanium alloy.

13. The method recited in claim 1, wherein the titanium alloy in the resized helmet comprises a ultimate tensile strength of about 146,000 psi, and a yield strength of about 133,000 psi, with a 9% elongation.

14. The method recited in claim 1, wherein the method further includes applying a finishing process to the resized helmet after the chemical milling.

15. The method recited in claim 1, wherein the titanium alloy is a 6Al 4V titanium alloy.

16. The method recited in claim 1, wherein the hot isostatic press process applies a pressure of about 15,000 psi and a temperature of about 1650° F. for about 2 hours.

17. The method recited in claim 1, wherein the oversized mold is an investment mold.

18. The method recited in claim 1, wherein the casting is an expendable mold casting process.

* * * * *